United States Patent [19]

Alston

[11] 4,366,188

[45] Dec. 28, 1982

[54] METHOD OF EMPLOYING ENCAPSULATED MATERIAL

[75] Inventor: Julia M. Alston, Myrtle Bank, Australia

[73] Assignee: Moore Business Forms, Inc., Grand Island, N.Y.

[21] Appl. No.: 121,134

[22] Filed: Feb. 13, 1980

Related U.S. Application Data

[63] Continuation-in-part of Ser. No. 37,417, May 9, 1979, abandoned, which is a continuation-in-part of Ser. No. 485,779, Jul. 5, 1974, abandoned.

[30] Foreign Application Priority Data

Jul. 9, 1973 [AU] Australia ..... 4001
Jan. 14, 1974 [AU] Australia ..... 6256

[51] Int. Cl.[3] ..... B41M 3/12

[52] U.S. Cl. ..... 427/150; 427/151; 427/152; 427/335; 427/336; 427/383.1; 427/395; 427/411; 427/419.2; 427/419.8

[58] Field of Search ..... 427/145, 150, 151, 152, 427/336, 411, 335, 395, 383.1, 391, 419.2, 419.8; 428/307, 306

[56] References Cited

U.S. PATENT DOCUMENTS

| | | | |
|---|---|---|---|
| Re. 28,779 | 4/1976 | Kateyama et al. | 428/307 |
| 3,386,822 | 6/1968 | Brynko | 427/145 |
| 3,427,180 | 2/1969 | Phillips | 427/145 |
| 3,432,327 | 3/1969 | Kan et al. | 427/145 |
| 3,444,809 | 5/1969 | Ohkudo et al. | 427/145 |
| 3,446,184 | 5/1969 | Johnson | 427/145 |
| 3,446,617 | 5/1969 | Stricklin | 427/145 |
| 3,762,944 | 10/1973 | Sloan et al. | 427/145 |
| 3,824,101 | 7/1974 | Nihyakumen et al. | 427/145 |
| 3,843,383 | 10/1974 | Ishige et al. | 427/145 |
| 3,847,832 | 11/1974 | Matsukawa et al. | 428/307 |
| 3,906,123 | 9/1975 | Vincent et al. | 427/145 |
| 3,931,417 | 1/1976 | Wright | 427/145 |
| 4,097,279 | 6/1978 | Whitehead | 427/145 |

*Primary Examiner*—Michael R. Lusignan
*Assistant Examiner*—Janyce A. Bell
*Attorney, Agent, or Firm*—Kinzer, Plyer, Dorn & McEachran

[57] ABSTRACT

A method of intensifying or amplifying an image substrate obtained by imagewise release or transfer of a microcapsular substance which is liquid at room temperature, unaltered in state, by a pigment developer, and fixing the image.

6 Claims, No Drawings

METHOD OF EMPLOYING ENCAPSULATED MATERIAL

This application is a continuation-in-part of application Ser. No. 037,417, filed May 9, 1979, (now abandoned) which in turn was a continuation-in-part of application Ser. No. 485,779, filed July 5, 1974 and now abandoned.

BACKGROUND OF THE INVENTION

Pressure sensitive copying papers sometimes also called carbonless copy papers are widely used. A pressure sensitive copying paper system typically consists of a transferring sheet and a receiving sheet. One side of the transferring sheet is coated with microcapsules containing usually unreacted oil soluble coloring matter of the electron donor type which is encased in a thin wall of a polymeric material or gelatin or the like. The receiving sheet on the other hand is coated on one side with a special mineral or clay or polymer coating of the electron acceptor type and a binder. The sheets are superimposed so as to obtain an intimate contact between the two coated surfaces. If pressure is applied to these sheets by impact computer printout or typewriting or handwriting the microcapsules are ruptured in the impact or pressure areas and the coloring matter is transferred from the ruptured capsules to the adjacent mineral or clay or polymer coating of the receiving sheet whereby the electron donor type coloring matter is caused to react with the electron acceptor coating of the receiving sheet and as a result of this a colored localised marking corresponding to the impact or pressure area is formed on the receiving sheet. A pressure sensitive copying paper system consists basically of a first or top sheet coated on its reverse side this being the transfer surface with the microcapsules and the second sheet coated on its front side this being the receiving sheet with the mineral or clay or polymer coating. Pressure sensitive copying papers are particularly adaptable to manifolding where the papers form a multi-ply set, such as for instance a computer printout set or a five part sales form, where three intermediate sheets are coated on their front sides with the clay coating and on their reverse sides with microcapsules whereas the top sheet is coated on its reverse side only with microcapsules and the bottom sheet coated only on its front side with the clay coating.

Methods of forming microcapsules and of encapsulating a variety of substances are described for instance in U.S. Pat. Nos. 2,183,053, 3,016,308, 3,429,827, 3,516,941 and 3,533,958.

The copies produced by the use of the above described pressure sensitive copying paper have certain shortcomings in that for instance it is not possible to produce high intensity images, recorded information is not permanent as it is generally subject to light fading, thermal fading, molecular disintegration and the like. In addition the image density is generally inadequate for such information to be processed through an optical character recognition device. Further the image composition is not suited to magnetic image character recognition.

SUMMARY OF THE INVENTION

Accordingly the general object of this invention is to overcome the shortcomings mentioned in the foregoing in relation to the use of microcapsules in pressure sensitive copying systems and to further extend the field in which encapsulated materials can be employed. The above is attained in accordance with this invention by utilising the image or pattern formed by the encapsulated substance released from imagewise or patternwise ruptured microcapsules to produce copies having enhanced density and contrast for character recognition processes wherein such members are formed by attracting and fixing to said released encapsulated substance powder materials.

It is therefore an object of this invention to improve image quality obtainable in pressure sensitive systems of the microcapsular type.

Another object of the present invention is to increase the number of manifold copies of readable or useable quality obtainable in pressure sensitive systems of the microcapsular type.

A further object of this invention is to provide a method for obtaining high quality images of any desired color in pressure sensitive systems of the microcapsular type.

A still further object of this invention is to provide a method whereby images formed in pressure sensitive systems of the microcapsular type can be processed by optical and magnetic character recognition devices.

Other advantages of the method of the present invention will become apparent from the following description.

The present invention involves basically a process of improving the density and contrast of the image formed by the capsules being ruptured by pressure or impact printing. As described in the foregoing pressure or impact printing causes the rupture of microcapsules whereby the encapsulated substance is released and transferred to another surface in intimate contact with the capsule coated surface. We have now found that such image formed by the substance released from the ruptured capsule can be rendered of substantially higher density by the application thereto of a powdered substance of colored nature provided such released substance is capable of retaining said powder by adhesion or reaction or otherwise combination therewith. The thus retained powder image can be fixed to the surface if so desired or transferred to another surface for instance electrostatically and fixed thereon. The pattern formed by such substance released from the ruptured capsules can be developed on the capsule coated surface itself or on the conventional receiving sheet whereto at least a part of the released substance has been transferred or on any other suitable surface such as for instance plain paper on to which the substance released from the ruptured capsules have been transferred. By proper selection of the developing powder and of the encapsulated substance it is possible not only to overcome the previously described shortcomings of the prior art but also to obtain recorded information of quality and applicability heretofore not possible by the use of pressure sensitive copying materials of the prior art.

In accordance with this invention the sheet carrying the capsule coating can be prepared by applying a layer of microcapsules containing the desired encapsulated substance to a suitable surface of a substrate such as paper by known means of coating such as for instance described in U.S. Pat. No. 3,016,308 and it is also possible to employ microcapsules contained within the body of paper, such method of incorporating microcapsules with paper pulp being disclosed for instance in U.S. Pat.

No. 3,516,941. Alternatively many commercially available microcapsular pressure sensitive papers such as business forms, computer printout multi-ply forms and the like can be employed in accordance with this invention provided the encapsulated substance is suitable for the required application. The encapsulated substance contained within the microcapsules is one capable of retaining the colored powder by adhesion or reaction or otherwise combination therewith. Thus in those instances when the colored powder consists of dye or dyed or pigmented resin particles, the encapsulated substance may comprise a solvent for the dye or for the resin, such as hydrocarbons, halogenated hydrocarbons, alcohols and water. Alternatively the encapsulated substance may be a tacky material such as a resin or a mineral or vegetable oil or a plasticiser or an adhesive capable of causing the colored powder material to adhere to a surface in those areas where such encapsulated substance released from the ruptured capsules has rendered the surface tacky. Methods of encapsulating substances of the aforementioned types are described for instance in U.S. Pat. Nos. 3,016,308, 3,429,827 and 3,516,941.

The colored powders can be of the type employed for instance as so called toners for developing latent electrostatic images in copying machines and the like as well known in the art which toners consist of particles comprising polymeric material or pigments or dyes of any desired color and a polymeric binder. Such particulate matter can be fixed to the surface in areas where it is retained by the encapsulated substance released from the ruptured capsules by the application of heat in those instances where the polymeric material contained in the developer powder is of thermoplastic nature. In other instances it is possible to fix the developed powder image to the surface by employing a solvent as the encapsulated substance which solvent in the image areas where it has been released from the ruptured capsules can solvate or tackify at least in part the polymeric material or the dye contained within the developer particles. Alternatively it is possible to fix such powder images to the surface by the application thereto of a solvent or solvent vapor which is capable of solvating or tackifying at least in part the polymeric material or dye contained within said colored particles. In certain instances it is possible to select a powder substance which may react or combine with the released encapsulated material. We have also found that the particles forming the powder substance may consist of or contain metallic powders as well as magnetic material in particulate form such as ferrite and the like.

The colored powder can be applied to the surface containing latent images formed by the released encapsulated substance from ruptured capsules by simple dusting or by the well known methods of cascade, magnetic brush, powder cloud and the like developments as employed in electrostatic office copiers.

We found that in many instances the latent image may be developed many hours after its formation on a surface provided the encapsulated substance is selected so as to remain on such surface for the required period.

It is to be emphasized the encapsulated liquid substance is a liquid at room temperature and in the course of imagewise transfer to the receiving sheet undergoes no change in state as the image substrate of the ultimate intensified or amplified image.

It has been known for many years a carbonless paper image is not always susceptible to clear photostatic reproduction as by an electrostatic copy machine, nor can the carbonless paper image always be read with assurance by an optical character recognition device. The reason is the carbonless paper image is a dye image and its color absorbancy has such a sharp absorption peak as not to be effectively absorbant in the light sensitivity region of photostatic copy machine for truly effective copy; for the same reason the carbonless paper image is not always susceptible to clear optical recognition, and is certainly not susceptible to magnetic recognition or read-out. The present invention enables a carbonless paper image to be developed to greater intensity, that is, amplified because the liquids employed in the carbonless paper technique (e.g. per U.S. Pat. Nos. 4,000,087, 4,042,412, 4,071,646 and 4,140,336) are also capable of serving as an image substrate to the pigment toner particles.

The present process is also to be distinguished from the Thermofax process of imaging exemplified by U.S. Pat. Nos. 3,446,184 and 3,446,617. There the paper sheet, on which a latent image may be developed subsequently by a pigment powder, is uniformly coated with a metastable solid which may be liquified imagewise by reflex heat when in heat conductive contact with a graphic original. The coated sheet, however, must be "beaten" paper which is more translucent and thinner than ordinary bond paper. A "beaten" sheet must be used in order that the heat may be effectively transmitted therethrough and onto the image presented by the graphic original. The image on the graphic original reflects (reflexes) the heat back to the metastable solid to liquify it imagewise. The coated sheet bearing the image darkens with age, as is well known, because of the nature of the solid substance required to liquify under reflex heat. The sheet is thin and brittle because it is "beaten" paper and it curls under humid conditions because the cellulose content expands in absorbing moisture while the coating does not. Indeed, it is recognized in U.S. Pat. No. 3,446,184 the operation of the Thermofax apparatus "depends in large part on the inherent moderate stiffness of the copy-sheet carrying the metastable liquid latent image." It is possible to transfer the liquid image to a receiving sheet and develop it there, but that requires a third sheet of paper.

Image intensification in accordance with the present invention is also functionally different from the process of toning electrostatic latent images such as for instance in electrophotographic office copying machines in that the process of the present invention does not involve electrostatic attraction of polarity sensitive electroscopic marking particles. However such electroscopic marking particles can be used as image intensifiers in accordance with the present invention provided they are of the correct physical and chemical type to be retained by the liquid forming the image pattern.

The following Examples will further illustrate the principles of this invention.

EXAMPLE 1

A commercially available microcapsular pressure sensitive two part form consisting of a top sheet having its lower surface coated with microcapsules as the transferring surface and a bottom sheet having its upper surface coated with the electron acceptor material as the receiving surface were used. The microcapsular coating upon examination appeared to be composed of gelatin walled microcapsules generally as described in U.S. Pat. No. 3,533,958. This set was placed in a typewriter and the top sheet was imaged. The sheets were then separated and a black developer powder was applied to each the transferring surface and the receiving surface whereby the powder adhered on each surface to the areas formed by the oily substance released imagewise from the ruptured capsules. The thus developed powder images were heat fused and found to be permanent, of high density and resolution.

The black developing powder was prepared as follows:

Carbon Black pigment: 50 g.

Polystyrene: 150 g.

were blended together in a heated Waring blender. This dispersion was applied to cool and then processed in a jet mill to an average particle size of about 15 microns.

The polystyrene was of thermoplastic type, melting point 100° C., estimated molecular weight 1500, specific gravity 1.06, acid number less than 1.0, flash point 505° F.

EXAMPLE 2

Paper was coated on one side with a slurry containing capsules of which the walls were of urea-formaldehyde, the encapsulated substance being dibutyl phthalate. The capsules were prepared in accordance with the teachings of U.S. Pat. No. 3,016,308. The coated side of the paper was contacted with the surface of a calendered plain paper and imagewise transfer of dibutyl phthalate from ruptured capsules on to the surface of the calendered plain paper was effected by impact computer printout. The areas formed by imagewise transferred dibutyl phthalate on the surface of the calendered paper were developed with the black developing powder of Example 1. The powder was found to adhere to the image areas. The developed image was heat fused and found to be comparable with that of Example 1.

EXAMPLE 3

Example 2 was repeated except that the Carbon Black of the developing powder was replaced with an equal weight of Phthalocyanine Blue pigment. The image was again heat fused and found to be permanent of blue color.

EXAMPLE 4

Example 2 was repeated except that a white bond paper was commonly used in optical character recognition devices (OCR) was substituted for the calendered plain paper. The fused black image when examined in an OCR tester was found to comply with the standards set for OCR processing.

EXAMPLE 5

Example 2 was repeated except that a standard cheque form was substituted for the calendered plain paper and the 50 g. of Carbon Black of the developing powder was replaced with 200 g. of the magnetic iron oxide, average particle size 0.8 microns. The fused image when examined in a magnetic image character recognition (MICR) tester was found to comply with the standards set for MICR processing.

EXAMPLE 6

Paper was coated on one side with a slurry containing capsules of which the walls were of polyamide, the encapsulated substance being toluene. The capsules were prepared in accordance with the teachings of U.S. Pat. No. 3,429,827. The coated side of the paper was contacted with the surface of a calendered plain paper and imagewise transfer of toluene from ruptured capsules on to the surface of the calendered plain paper was effected by impact computer printout. The sheets were then separated and a red developer powder was instantly applied to each surface whereby the powder adhered on each surface to the areas formed by the toluene released imagewise from the ruptured capsules. It was found that the toluene solvated the binder in the powder sufficiently to form a scuff-free image. The image was permanent and of high density.

The red developing powder was prepared as follows:

C.I. Pigment Red 57: 50 g.

Acrylic resin binder: 150 g.

were blended and processed to form a particulate powder as in Example 1.

The acrylic resin was of the thermoplastic type, n-butyl/isobutyl methacrylate copolymer, 50/50 proportion by weight, specific gravity 1.09, tack temperature 52° C.±2° C.

I claim:

1. A method of first producing and then intensifying the images on one of the more weakly imaged sheets in a computer printout carbonless paper manifold, involving the rupture of microcapsules in the manifold, and comprising:

forming an interface by contacting two paper surfaces of the manifold from which said weakly imaged sheet is to be formed and at least one of which paper surfaces contains a microcapsular coating of a liquid substance containing a dye which is liquid at room temperature, said substance being capable of forming an adhesive bond with or fusing with a developer pigment selected from the group consisting of carbon black, magnetic iron oxide, red pigment, blue pigment and a pigmented resin or polymer;

releasing said liquid substance imagewise to form an initial original visible dye image on at least one of said paper surfaces at the interface by the imagewise application of pressure applied to one of the papers;

intensifying said initial original dye image to greater optical or magnetic readout capability by applying thereto at least one of said pigments and finally fixing the intensified image by heat or solvation.

2. Method according to claim 1 in which the intensified image is intensified with magnetic powder and afterwards subjected to magnetic image character recognition.

3. Method according to claim 1 in which the intensified image is intensified with one of the pigments other than magnetic iron oxide and afterwards subjected to optical character recognition.

4. A method of first producing and then intensifying the images on one of the more weakly imaged sheets in a computer printout carbonless paper manifold, involving the rupture of microcapsules in the manifold, and comprising:

forming an interface by contacting two paper surfaces of the manifold from which said weakly imaged sheet is to be formed and at least one of which paper surfaces contains a microcapsular coating of a liquid substance containing a dye reactant which is liquid at room temperature and capable of reacting with an electron acceptor sheet to form a visible image, said dye reactant reacting to form a visible image upon imaging contact with an electron acceptor presented by the opposed paper surface, said liquid substance also being capable of forming an adhesive bond with or fusing with a developer pigment selected from the group consisting of carbon black, magnetic iron oxide, red pigment, blue pigment and a pigmented resin or polymer;

releasing said liquid substance imagewise to form an initial visible image on the electron acceptor paper surface at the interface by the imagewise application of pressure applied to one of the papers;

intensifying said initial original dye reactant image to greater optical or magnetic readout capability by applying thereto at least one of said pigments and finally fixing the intensified image by heat or solvation.

5. Method according to claim 4 in which the intensified image is intensified with magnetic powder and afterwards subjected to magnetic image character recognition.

6. Method according to claim 4 in which the intensified image is intensified with one of the pigments other than magnetic iron oxide and afterwards subjected to optical character recognition.

* * * * *